US008356608B2

(12) United States Patent
Takehana

(10) Patent No.: US 8,356,608 B2
(45) Date of Patent: Jan. 22, 2013

(54) DEVICE AND METHOD FOR STYLING HAIR

(75) Inventor: Miki Takehana, Tokyo (JP)

(73) Assignee: Kikuboshi Corporation, Tokyo (JP)

( * ) Notice: Subject to any disclaimer, the term of this patent is extended or adjusted under 35 U.S.C. 154(b) by 246 days.

(21) Appl. No.: 12/733,302

(22) PCT Filed: Apr. 30, 2008

(86) PCT No.: PCT/JP2008/058271

§ 371 (c)(1),
(2), (4) Date: Feb. 23, 2010

(87) PCT Pub. No.: WO2009/028237

PCT Pub. Date: Mar. 5, 2009

(65) Prior Publication Data

US 2010/0206321 A1 Aug. 19, 2010

(30) Foreign Application Priority Data

Aug. 29, 2007 (JP) ..... 2007-222329

(51) Int. Cl.

| | |
|---|---|
| ***A45D 7/04*** | (2006.01) |
| ***A45D 7/00*** | (2006.01) |
| ***A45D 2/00*** | (2006.01) |
| ***A45D 20/08*** | (2006.01) |

(52) U.S. Cl. ..... 132/207; 132/210; 132/223; 132/271

(58) Field of Classification Search ..... 132/211, 132/200, 206, 207, 210, 212, 119.1, 229, 132/226, 227, 230–235, 237, 223, 224, 269, 132/271, 265, 266; 34/96, 283, 101; 310/36, 310/37; 219/225; 15/22.1; 607/110
See application file for complete search history.

(56) References Cited

U.S. PATENT DOCUMENTS 1,858,851 A * 5/1932 Buchanan ..... 132/118
(Continued)

FOREIGN PATENT DOCUMENTS

JP 08-299046 A 11/1996
(Continued)

OTHER PUBLICATIONS

International Search Report dated May 27, 2008, issued on PCT/JP2008/058271.

*Primary Examiner* — Vanitha Elgart
(74) *Attorney, Agent, or Firm* — Edwards Wildman Palmer LLP; James E. Armstrong, IV; George N. Chaclas

(57) ABSTRACT

Provided are a device and a method for styling hair capable of reducing damage to hair, maintaining the elasticity and texture of the hair, and keeping the hair style for a long period of time. The hair styling device is equipped with an arm body 2 having an arm 2A and an arm 2B connected to each other, an oscillation means 3, and an oscillator 9. The arm body 2 is constituted such that it can retain or release the hair. The oscillation generated from the oscillation means 3 has a predetermined frequency from 1 to 20000 Hz. The oscillator 9 is constituted such that it can slide along the length direction of the arms 2A and 2B and at the same time can transmit the oscillation from the oscillation means to the hair retained by the arm 2 while sliding.

16 Claims, 6 Drawing Sheets

U.S. PATENT DOCUMENTS

| | | | | | |
|---|---|---|---|---|---|
| 3,272,023 | A | * | 9/1966 | Ferguson et al. | 74/55 |
| 3,393,686 | A | * | 7/1968 | Goble | 132/207 |
| 3,526,234 | A | * | 9/1970 | Chrablow | 132/204 |
| 3,581,056 | A | * | 5/1971 | Djenner | 219/222 |
| 3,642,010 | A | * | 2/1972 | Kuris | 132/201 |
| 3,701,354 | A | * | 10/1972 | May | 132/119.1 |
| 4,023,579 | A | * | 5/1977 | Suroff | 132/272 |
| 5,078,157 | A | * | 1/1992 | Golan et al. | 132/119.1 |
| 5,297,512 | A | * | 3/1994 | Sharp | 119/602 |
| 5,343,881 | A | * | 9/1994 | Golan et al. | 132/119.1 |
| 5,799,671 | A | * | 9/1998 | Takimae | 132/225 |
| 5,875,789 | A | | 3/1999 | Shigihara | |
| 5,881,739 | A | * | 3/1999 | Walker et al. | 132/224 |
| 6,526,988 | B2 | * | 3/2003 | Takehana | 132/207 |
| 7,296,581 | B2 | * | 11/2007 | Gold | 132/212 |
| 7,540,289 | B2 | * | 6/2009 | Habibi | 132/224 |
| 7,554,225 | B2 | * | 6/2009 | Kraus et al. | 310/36 |
| 7,597,107 | B2 | * | 10/2009 | Imai et al. | 132/212 |
| 7,958,897 | B2 | * | 6/2011 | Uchinashi | 132/223 |
| 2002/0026206 | A1 | | 2/2002 | Takehana | |
| 2003/0106564 | A1 | * | 6/2003 | Olshavsky et al. | 132/207 |
| 2003/0163882 | A1 | * | 9/2003 | Blaustein et al. | 15/22.2 |
| 2006/0196523 | A1 | | 9/2006 | Choi | |
| 2006/0272665 | A1 | * | 12/2006 | Yamamoto et al. | 132/207 |
| 2009/0266378 | A1 | * | 10/2009 | Nunomura | 132/224 |
| 2009/0288675 | A1 | * | 11/2009 | Nunomura | 132/224 |
| 2011/0079238 | A1 | * | 4/2011 | Takehana | 132/269 |
| 2011/0108051 | A1 | * | 5/2011 | Yahnker et al. | 132/229 |
| 2011/0108053 | A1 | * | 5/2011 | Yahnker et al. | 132/269 |

FOREIGN PATENT DOCUMENTS

| | | | | |
|---|---|---|---|---|
| JP | 09-262119 | A | | 10/1997 |
| JP | 09-262120 | A | | 10/1997 |
| JP | 09-262121 | A | | 10/1997 |
| JP | 09-262123 | A | | 10/1997 |
| JP | 2000-079013 | A | | 3/2000 |
| JP | 2006-239388 | A | | 9/2006 |
| WO | WO2007/037143 | | * | 4/2007 |

* cited by examiner

*Prior Art*

DEVICE AND METHOD FOR STYLING HAIR

TECHNICAL FIELD

The present invention relates to a device and a method for styling hair.

BACKGROUND ART

A treatment technology (perming technology) for giving a desired style to hair such as permanent hair straightening or permanent waving is conventionally carried out by sectioning the whole hair which has been cleaned with a shampoo into some portions before or after applying or spraying a first lotion (softening agent or reducing agent, or it may be called "cold perm lotion") or the like to the whole hair for softening; subjecting the thus sectioned hair to heat treatment or combing treatment, applying a substance in cream form to the sectioned hair, or wrapping the thus sectioned hair on hair rods in the case of permanent waving; applying or spraying a second lotion (setting agent or oxidizing agent, or it may be called "cold perm lotion") as a setting treatment; and after removing the hair rods, if the hair has been wrapped thereon, finally subjecting the hair to warm-water rinsing or the like treatment.

This means that the conventional hair styling treatment technology such as perming or conditioning treatment depends only on so-called chemical treatment in which a first lotion (reducing agent) is applied to the hair wrapped on rods or the like to break a cystine bond of the hair and the linkage thus broken is bound again with a second perming lotion (oxidizing agent) while the hair is transformed by the rods or the like. A hair style retention effect after permanent hair straightening, permanent waving, or conditioning does not last long. This is presumed to occur because breakage of the cystine bond is insufficient because the perming lotion does not penetrate into even the deep portion of the hair sufficiently, or the cystine bond itself becomes weak due to hair damage at the time of perming or the like treatment.

In order to prolong the hair style retention effect of the cold perm lotion or the like, attempts have been made, for example, for adjusting the pH of the cold perm lotion, depending on the properties of the hair of an individual person subjected to perming treatment. Satisfactory hair style retention effect however has not yet been achieved.

It is presumed that a number of polypeptide chains (main chains) constituting keratin, a principal component of hair, are arranged in a longitudinal direction of hair and polypeptide chains adjacent to each other are connected via side chains such as cystine bond, salt bond, or hydrogen bond to form a mesh structure. Due to this linkage, the hair is presumed to have high elasticity and have resilience so that immediately after the hair bent with a hand is released therefrom, it can restore the original shape.

Weakening this restoring force, which has been given by a side chain bond such as the cystine bond, salt bond, or hydrogen bond, by breaking the bond is the action of a first permanent wave lotion, while restoring the side chain bond at a new bent position is the action of a second permanent wave lotion. It is presumed that sustainable waves or the like are formed by this series of reactions. Of course, this principle can be similarly applied to hair relaxing for straightening frizzled hair or change of wavy hair to straight hair.

In the hair styling process, it is also the common practice to carry out, together with the above-mentioned hair styling treatment, heat treatment (physical treatment) in which hair is heated at a certain temperature for a certain period of time.

This heat treatment effectively utilizes, for changing the hair style, thermal plasticity which medulla, cortex, matrix, cuticle, and the like constituting the hair have. It aims to achieve a synergistic effect with the action of the lotion (chemical treatment) to the hair.

Since the above-mentioned hair styling method such as permanent waving uses a chemical or heat, a great care should be taken so as to precisely follow the direction for use or take a precise amount of the chemical. When the first permanent wave lotion breaks the cystine bond in the keratin too severely to make reforming of the cystine bond impossible, the hair is damaged greatly. When the treatment with the second permanent wave lotion is insufficient, the hair is damaged and at the same time, the hair cannot be formed into a desired style.

As a measure against the above problems, Patent Document 1 discloses a method and device for styling hair by applying thereto ultrasonic oscillation without using a chemical or heat. Patent Document 2 discloses a method of using both ultrasonic oscillation and a cold permanent wave lotion. Further, Patent Documents 3 to 5 disclose a hair setting device utilizing ultrasonic oscillation.

The method and device disclosed in Patent Documents 1 to 5 however cannot give, to hair, ultrasonic oscillation corresponding to the properties of the hair such as hair style. They may presumably damage the hair and are not satisfactory for maintaining the elasticity and texture of the hair. In addition, they do not correspond to the properties of the hair such as hair style so that the hair style obtained using them cannot be maintained for a long period of time. Accordingly, they are not satisfactory as a device or method for styling hair.

Patent Document 1: JP-A-08-299046
Patent Document 2: JP-A-09-262120
Patent Document 3: JP-A-09-262119
Patent Document 4: JP-A-09-262121
Patent Document 5: JP-A-09-262123

DISCLOSURE OF THE INVENTION

The present invention has been made in consideration of the above-described problems of the conventional art. An object of the present invention is to provide a device and a method for styling hair capable of reducing the damage to the hair as much as possible, keeping the elasticity and texture of the hair, and at the same time, keeping the hair style for a long period of time by giving, to the hair softened by softening agent application or spraying, oscillation corresponding to the properties of the hair such as hair style.

The following device and method for hair styling are provided by the present invention.

[1] A hair styling device for giving a desired hair style to hair softened by softening agent application or spraying or hair applied with a hair conditioner, which comprises an arm body having one arm and the other arm pivotably connected to each other via a connection mechanism, an oscillator unit placed in the one arm, the other arm, or the device main body and generating oscillation having a predetermined frequency, and an oscillator placed in the one or the other arm and constituted such that it can transmit the oscillation generated by the oscillation means to the hair, wherein the arm body is constituted such that it can retain or release the hair by rotating the connection mechanism, the oscillation generated by the oscillation means has a predetermined frequency of from 1 to 20000 Hz, and the oscillator is constituted such that it can slide along the length direction of the one or the other arm and at the same time, transmit the oscillation from the oscillation means to the hair retained by the arm body while sliding.

[2] The hair styling device as described in [1], wherein the device main body is constituted as a first gripper graspable with a hand, a second gripper graspable with a hand is placed integral or in connection with the one arm of the arm body, and the one arm and the other arm are constituted as the arm body rotating via the connection mechanism by opening or closing the first gripper and the second gripper.

[3] The hair styling device as described above in [1] or [2], wherein the oscillation of the oscillation means having an amplitude ranging from 0.001 to 10 mm.

[4] The hair styling device as described above in any one of [1] to [3], wherein the frequency of the oscillation means is constituted variable.

[5] The hair styling device as described above in any one of [1] to [4], wherein the hair styling device is a hair iron.

[6] The hair styling device as described above in [5], wherein the device is the hair iron as described in [5], the oscillators are placed in the one arm and the other arm, respectively, and the oscillation generated by the oscillation means is given to either one or both of the oscillators, or these two oscillators alternately.

[7] The hair styling device as described above in [6], wherein a contact surface to be brought into contact with the hair is placed in either one or both of the oscillators, and the contact surface has been subjected to treatment for repeatedly forming slow wave patterns thereon.

[8] The hair styling device as described above in any one of [1] to [7], wherein a portion of the hair styling device to be brought into contact with the hair is made of an elastic material.

[9] A hair styling method for imparting a desired hair style to hair softened by softening agent application or spraying or hair applied with a hair conditioner, which comprises giving, to the hair, oscillation having a predetermined frequency ranging from 1 to 20000 Hz while holding the hair carefully enough to avoid collapse thereof and thereby repeating a reciprocal rotating motion of the hair.

[10] The hair styling method as described above in [9], wherein the oscillation to be imparted to the hair has an amplitude falling within a range of from 0.001 to 10 mm.

[11] The hair styling method as described above in [9] or [10], wherein the hair styling is performed with a hair iron suited for use in the hair styling method.

[12] The hair styling method as described above in any one of [9] to [11], wherein a portion to be brought into contact with the hair is made of an elastic material.

By causing the effect of the first lotion (softening agent) to appear adequately, the present invention enables to break, in perming such as permanent hair straightening or permanent waving, the cystine bond, salt bond, hydrogen bond, and the like in the keratin of the hair uniformly throughout the hair, which cannot be achieved by the conventional permanent wave treatment. In addition, the present invention enables to carry out hair styling treatment smoothly and thereby reduce the treatment time. After setting treatment, a new hair style is imparted even to the details of the hair and therefore, the cystine bond of the keratin is reformed even in the details of the hair so that the hair style after the treatment is retained for a prolong period of time. Further, the present invention enables to carry out delicate hair styling treatment which has not been achieved by the conventional permanent waving so that an elegant or unique hair style can be imparted to the hair.

DESCRIPTION OF REFERENCE NUMERALS

1, 11, 21, 31, 41: hair iron, 2: arm body, 2A: one arm, 2B: the other arm, 3: oscillation means, 4A: device main body (first gripper), 4B: second gripper, 5: connection mechanism,

6: ceramic actuator, 7: power supply code, 8: rivet portion, 9: oscillator, 10: cam mechanism, 11: connection structure, 11*a*: connected portion, 11*b*: L-shaped portion, 12: opening portion, 12*a*, 12*b*: opening end portion, 13: recess, 14*a*, 14*b*: contact end portion, 16: oscillator supporting portion, 20A: upper arm, 20B: lower arm, 31: hair iron, 22: motor, 23: eccentric cam, 24: cam, 25: oscillation transmitter, 26: hair, 33Y: arrow, 34Y: arrow, 37: black dot, 40: oscillation absorber (anti-oscillation device), 47*a*: protrusion, 47*b*: recess, 49: heater with built-in oscillator.

BEST MODE FOR CARRYING OUT THE INVENTION

The best mode for carrying out the hair styling device of the present invention will hereinafter be described specifically referring to accompanying drawings. It should however be borne in mind that the present invention widely embraces hair styling devices equipped with defining matters of the invention and is not limited by the following embodiments.

[1] Constitution of the Hair Styling Device of the Present Invention

Figure 1:
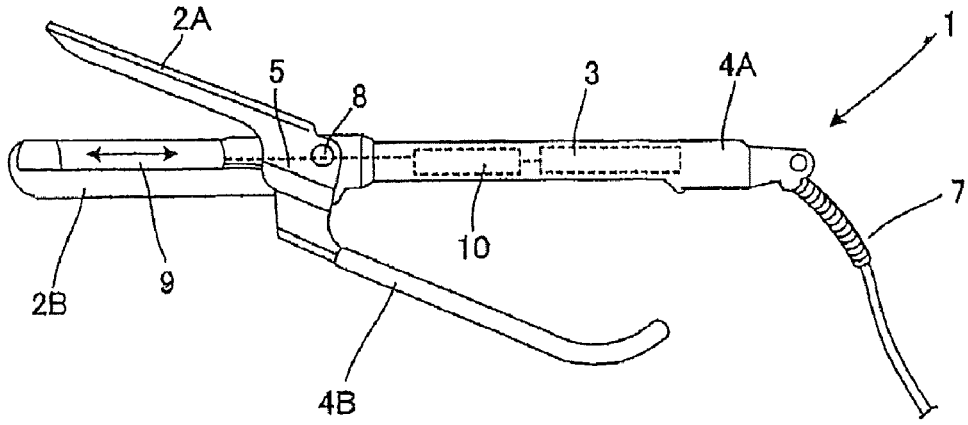
FIG. 1 is a schematic view and also a perspective view illustrating Embodiment 1 of the hair styling device according to the present invention.

The hair styling device according to the present invention is constituted such that it can impart a desired hair style to the hair softened by applying or spraying thereto a softening agent or the hair applied with a hair conditioner. As illustrated in FIG. 1, a hair styling device 1 according to the present invention is equipped with an arm body 2 having one arm 2A and the other arm 2B pivotably connected via a connection mechanism 5; an oscillation means 3 placed in the one arm 2A, the other arm 2B, or the device main body 4A and generating oscillation having a predetermined frequency; and an oscillator 9 placed in the one arm 2A or the other arm 2B and is constituted such that it can transmit the oscillation generated by the oscillation means 3 to the hair. The arm body 2 is constituted such that the hair can be retained or released by the rotation of the connection mechanism 5. The oscillation generated by the oscillation means 3 has a predetermined frequency ranging from 1 to 20000 Hz. The oscillator 9 is constituted such that it can slide along the length direction of the one arm 2A or the other arm 2B and can transmit, while sliding, the oscillation from the oscillation means 3 to the hair retained by the arm body 2.

[1-1] Hair to be Styled in the Invention

The hair styling device 1 of the present invention can be used suitably for the hair softened by applying or spraying thereto a softening agent or the hair applied with a conditioner (which may hereinafter be called "hair subjected to softening or the like treatment", as needed). In other words, the hair styling device of the present invention is suitably used for hair styling treatment. The softening or the like treatment is performed by shampooing hair and then applying or spraying a first lotion (softening agent) carefully thereto. The hair styling device according to the invention can be suitably used for the hair subjected to softening or the like treatment. It is however needless to say that the device is used not only for the hair subjected to softening or the like treatment but it exhibits an excellent effect when used for the hair not subjected to softening or the like treatment.

[1-2] Oscillation Means:

The oscillation means 3 of the present embodiment oscillates the oscillator 9 to give (impart) oscillation to the hair subjected to softening or the like treatment and therefore has a function as a so-called power source. In FIG. 1, the oscillation means 3 is placed in the device main body 4A. The oscillation means is placed in not only the device main body but may be placed in, for example, the arm body 2.

Examples of the oscillation means 3 include electric motors such as tiny motor and flat motor, electromagnetic actuators, and ceramic actuators. Those connectable via a power code 7 to a household power source are included in them. The oscillation means 3 comprised of a ceramic actuator or the like can directly convert an electric energy to a mechanical translatory movement energy, which enables improvement in an energy efficiency and power saving. The operation of the oscillation means is started or finished by using a known power switch or the like. When an electric motor that outputs a rotating motion is used as the oscillation means, on the other hand, the rotating motion may be converted to a translatory movement by using a cam mechanism 10 to oscillate the oscillator as described later. The oscillation means thus constituted is preferably as light as possible because an excessively heavy means may impose a burden on the hair styling work.

The oscillation means 3 is constituted such that it can generate oscillation having a predetermined frequency ranging from 1 to 20000 Hz. When the oscillation means has such a constitution, the hair which has finished softening or the like treatment and has received oscillation from the longitudinal direction of the arm 2B repeats a reciprocal motion while rolling on the arm 2B (oscillator 9) at least along the outer circumference of the hair itself and being supported by the arm body 2 even if the motion does not become a rotating motion. Further, when the frequency is increased within the predetermined frequency, the oscillation having the thus increased frequency enables repetition of a reciprocal rotating motion along the outer circumference of the hair. Thus, by constituting the oscillation means so that it can generate oscillation having a predetermined frequency within a range of from 1 to 20000 Hz, it is possible to uniformly cause breakage of the cystine bond, salt bond, hydrogen bond, and the like in the keratin of the hair even in the details of the hair, which has not been performed in the conventional permanent wave treatment. Further, the hair styling treatment can be carried out smoothly so that the treatment time can be reduced. The hair is therefore not damaged and can keep its soft circular cross-sectional shape.

The oscillation generated by the oscillation means 3 has preferably a frequency ranging from 10 to 100 Hz. Oscillation having a low frequency within a range of from 10 to 100 Hz can provide a greater amplitude than that provided by ultrasonic oscillation. Giving such low-frequency oscillation to hair along the longitudinal direction of the arm 2B from the side-surface direction of the hair as illustrated in FIG. 1 enables to repeat the reciprocal rotating motion of the hair stably. Accordingly, the hair can keep its soft circular cross-section without being damaged. The reason is not clear but hair styling treatment while giving oscillation from a predetermined direction promotes penetration of the first lotion to the hair to soften the hair, thus enhancing the effect of the first lotion. Such a hair styling treatment is therefore preferred. It therefore becomes possible to keep elasticity and texture of the hair by controlling the frequency of the oscillation means to fall within a desired range.

Further, the oscillation means is constituted such that its frequency can be varied. Since the hardness, width, or the like of the hair varies between individuals, the oscillation means constituted such that its predetermined frequency can be varied is one of preferred embodiments because it enables to perform hair styling treatment, depending on the hair properties of individuals.

The amplitude of the oscillation of the oscillation means is preferably within a range of from 0.001 to 10 mm, more preferably from 0.2 to 1 mm. In general, the width of the human hair is from 0.06 to 0.1 mm and the perimeter of the hair is from 0.19 to 0.31 mm. This means that when the reciprocal rotating motion of the hair is repeated, the amplitude is within the above-described predetermined range so that the hair can keep its soft circular cross-section without suffering damage which will otherwise occur due to excessive deviation to right rotation or left rotation or excessive rotation. As a result, the hair can keep its elasticity and texture. Constitution of the oscillation of the oscillation means in the above-described manner is one of the preferred embodiments because the hair styling treatment while adding (imparting) oscillation in a predetermined direction is presumed to promote penetration of the first lotion to the hair, soften the hair, and thus enhance the effect of the first lotion.

The perimeter of the hair corresponding to one rotation is from 0.19 to 0.31 mm, the perimeter of the hair corresponding to two rotations is from 0.38 to 0.63 mm, and the perimeter of the hair corresponding to three rotations is from 0.57 to 0.94 mm. The amplitudes not greater than 0.001 mm are not preferred because the hair does not rotate or rotates but not smoothly. The amplitudes exceeding 10 mm are also not preferred because they correspond to from 30 to 50 rotations and there is a possibility of hair breakage.

[1-3] Arm Body

The arm body 2 of the present embodiment is composed of the one arm 2A and the other arm 2B and the one arm 2A and the other arm 2B are connected pivotably via the connection mechanism 5. The one arm 2A and the other arm 2B are constituted pivotably enough to enable retention of the hair. There is a possibility that severe contact of these two arms during hair styling may collapse the hair sandwiched therebetween so that severe contact between the one arm and the other arm is not preferred. In the present embodiment, it is preferred to bring one arm and the other arm, the oscillator placed in one of these two arms and the other arm, or the oscillators placed in these two arms into contact with each other while suppressing the contact only to enable retention of the hair.

Figure 3A:
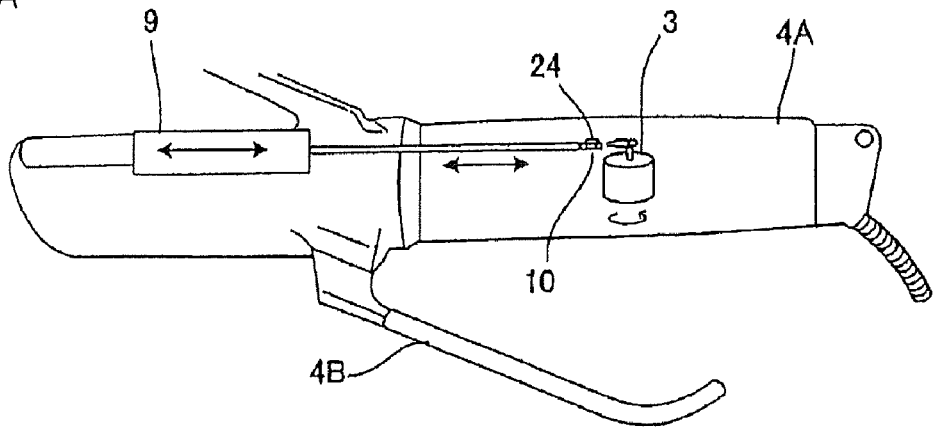
FIG. 3A is a partially enlarged view illustrating the embodiment of the hair styling device according to the present invention and is also a schematic view illustrating the positional relationship between an oscillator and peripheral members therearound.
Figure 3B:
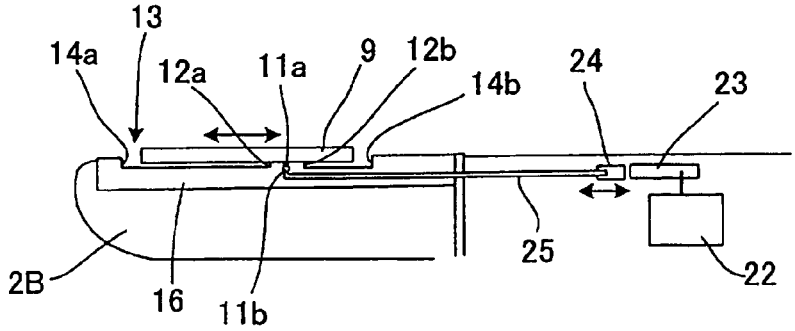
FIG. 3B is a partially enlarged view illustrating the embodiment of the hair styling device according to the present invention and is also a further enlarged schematic view of the schematic view of FIG. 3A.

Examples of the configuration of the arm body include column, rectangle, and rod. The configuration is not limited to them and that facilitating retention and release of the hair and at the same time facilitating rotation via the connection mechanism 5 is desired. In the arm body 2, the oscillator 9 illustrated in FIG. 1 is placed. When an oscillation transmitter 25 or the like illustrated in FIGS. 3A and 3B is placed therein, the arm body has preferably a hollow configuration. Not only such a hollow configuration but a configuration facilitating placement of the oscillator therein, that facilitating to give oscillation to the hair when the oscillator is placed therein, or that facilitating placement of another peripheral member may be embraced in examples of the arm body of the present embodiment.

The arm body is made of a known metal material such as titanium alloy, duralumin, aluminum alloy, or steel. The material is not limited to them, but the arm body may be made of a material which is light weight, has oscillation resistance and has durability. The arm body is made of preferably a material having the above properties and at the same time excellent heat resistance.

[1-3-1] Connection Mechanism

The arm body is, as illustrated in FIG. 1, constituted such that arms are connected pivotably via the connection mechanism 5. Described specifically, the one arm 2A and the other arm 2B are connected pivotably with a rivet portion 8 as an axis. The arm body is constituted so that arms can rotate vertically when viewed from a paper plane direction in FIG. 1. The connection mechanism is not limited to it but a known connection structure in which an arm body is provided pivotably is also embraced in the connection mechanism of the present embodiment. By moving the one arm 2A and the other arm 2B pivotably via this connection mechanism 5, the one arm 2A and the other arm 2B can smoothly perform retention and release of the hair.

For the hair styling device, how to retain the hair by the arm body is an important problem. For example, holding the hair with the arm while pressing strongly (under strong pressure) and carrying out hair styling treatment while maintaining the strong pressure give double or triple damage to the hair inevitably because the cross-section of the hair is already crashed when a strong pressure is applied thereto and hair treatment given to the crashed hair adds further damage to it. In other words, even if the arm is constituted such that it can give desired oscillation to the hair from a desired direction, the hair damaged under strong pressure continues to be pressed strongly and continuously during hair styling step. Not only the hair cannot rotate but also it cannot roll in the circumferential direction of the hair. Even if it rotates, there is a high possibility that the hair is crashed further. The hair receives double or triple damage and the elasticity and the texture of the hair cannot be maintained. In the present embodiment, therefore, the one arm 2A and the other arm 2B are constituted so that they can softly retain the hair via the connection mechanism 5 so as not to crash the hair and at the same time, can cause the hair to rotate in the circumferential direction thereof and further cause a reciprocal rotating motion of the hair while retaining the hair on these two arms.

[1-3-2] Another Constitution of the Arm Body

Figure 2:
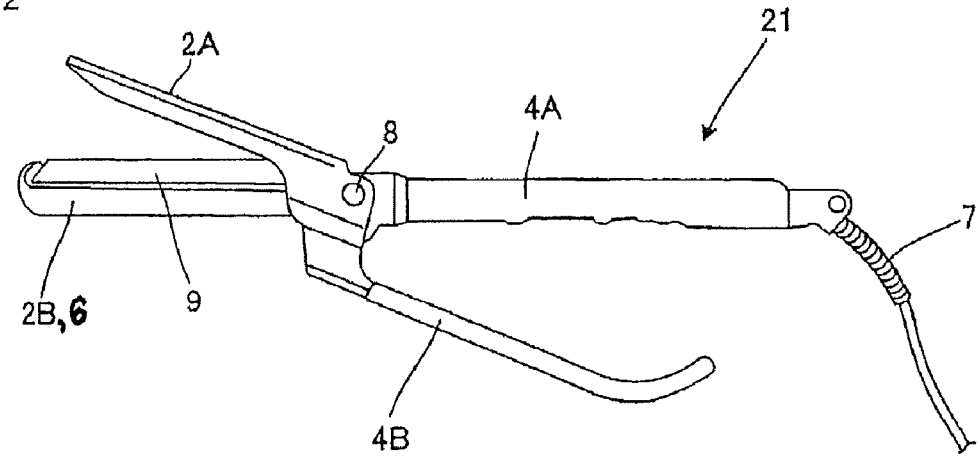
FIG. 2 is a schematic view and also a perspective view illustrating Embodiment 2 of the hair styling device according to the present invention.

It is also preferred that the above-described oscillation means is placed in the arm body. For example, by placing the oscillation means such as ceramic actuator 6 in the arm 2B of the arm body 2 as in the hair styling device 21 illustrated in FIG. 2, the oscillation transmission distance to the oscillator can be decreased, making it possible to give (transmit) desired oscillation to the hair stably. Placement of the oscillation means in the arm is therefore one of the preferred embodiments because it reduces the loss of oscillation transmission to the hair and enables stable and smooth adjustment of the oscillation to be imparted to the hair.

A biasing member such as spring which facilitates rotation (opening or closing between the one arm and the other arm) is preferably placed in the arm body, because it enables smooth retention and styling of the hair.

Figure 11:
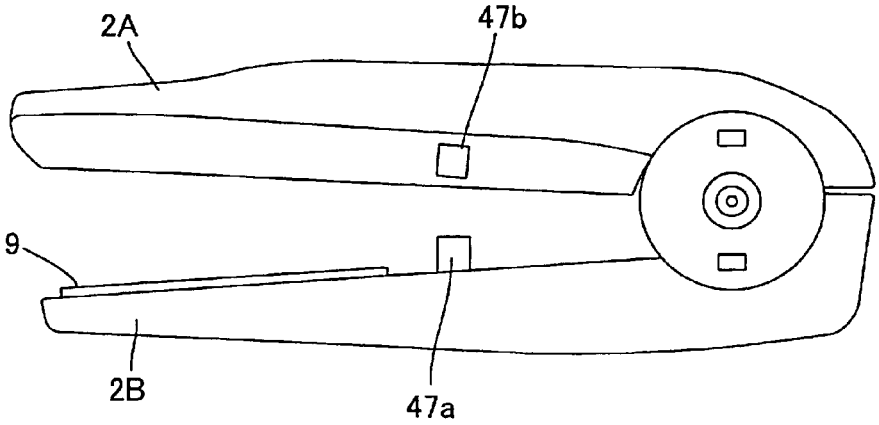
FIG. 11 is a schematic view illustrating Embodiment 5 of the hair styling device according to the present invention and is also a schematic view illustrating the hair styling device equipped with, in the arm pair thereof, a protrusion and a recess.

When the hair is retained by the one arm and the other arm, it is also preferred to equip the arm 2B with a protrusion 47*a* and the arm 2A with a recess 47*b* as illustrated in FIG. 11 in order to prevent the damage which will otherwise occur by an excessive pressing force from the one arm and the other arm. Such a constitution enables to prevent an excessive pressing force because even when the one arm and the other arm are likely to excessively push each other (the other arm and the one arm), the protrusion 47*a* and the recess 47*b* play a role as a stopper before they cause an excessive pressing force. Accordingly, a pressing force to the hair can be avoided.

[1-4] Oscillator

The oscillator is constituted as a flat plate member placed along the longitudinal direction of the arm body 2 as illustrated in FIGS. 1 and 3. The oscillator 9 is not limited to such a flat plate member but that having a configuration capable of giving oscillation along the longitudinal direction of the arm 2B (or arm 2A) from the side surface of the hair retained by the arm body 2 is suited as the oscillator of the present embodiment. The oscillator of the present embodiment may be made of such a member.

The oscillator 9 slides along the longitudinal direction of the arms 2A and 2B, responding to the oscillation generated by the oscillation means 3. At the same time, it gives (transmits), to the hair, the oscillation generated by the sliding. By constituting the oscillator 9 in such a manner, it is possible to cause a reciprocal rotating motion of the hair to prevent hair damage and thereby carrying out hair styling while maintaining a soft circular cross-section.

A description will next be made referring to the schematic views of FIGS. 3A and 3B illustrating the positional relationship between the oscillator 9 and the peripheral members. These drawings are illustrated to facilitate understanding of the relationship between the oscillator 9 and the peripheral members thereof and members such as the connection mechanism 5 and the rivet portion 8 of the arm body 2 are not illustrated. As illustrated in FIGS. 3A and 3B, when a motor 22 (oscillation generation means) which is a power output section generates oscillation, the oscillation is transmitted to the oscillator 9 via an eccentric cam 23, a cam 24, and the oscillation transmitter 25. The oscillator 9 to which the oscillation has been transmitted slides along the longitudinal direction of the arm 2B and by this sliding of the oscillator, oscillation can be transmitted to the hair along the longitudinal direction of the arms 2A and 2B. The relationship between the oscillator and the peripheral members thereof will be described more specifically in the column ([1-5]) concerning the relationship between the oscillator and the peripheral members thereof which will be described later.

Figure 4A:
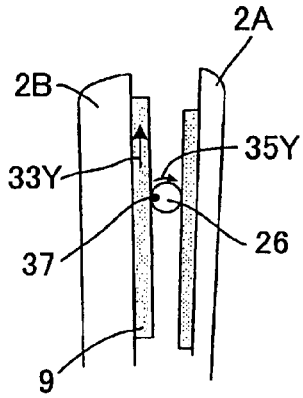
FIG. 4A is a partially enlarged view of an embodiment of the hair styling device according to the present invention and is also a schematic view illustrating the state under which the hair styling treatment is performed.
Figure 4B:
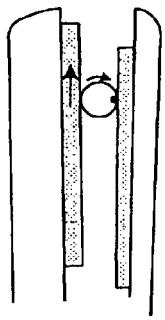
FIG. 4B is a partially enlarged view of the embodiment of the hair styling device according to the present invention and is also a schematic view illustrating the state under which the hair styling treatment is performed.
Figure 4C:
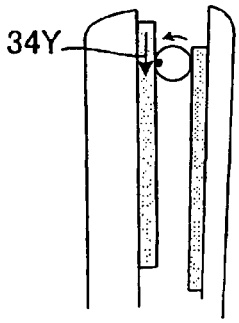
FIG. 4C is a partially enlarged view of the embodiment of the hair styling device according to the present invention and is also a schematic view illustrating the state under which the hair styling treatment is performed.
Figure 4D:
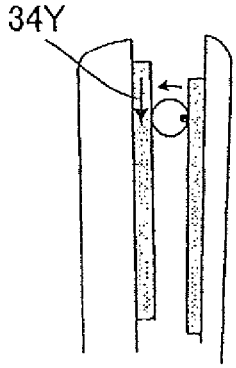
FIG. 4D is a partially enlarged view of the embodiment of the hair styling device according to the present invention and is also a schematic view illustrating the state under which the hair styling treatment is performed.
Figure 4E:
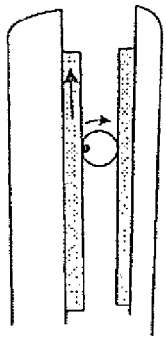
FIG. 4E is a partially enlarged view of the embodiment of the hair styling device according to the present invention and is also a schematic view illustrating the state under which the hair styling treatment is performed.

How the oscillator slides, how the sliding movement of the oscillator is transmitted to the hair as oscillation, and how the reciprocal rotating motion of the hair is performed will next be described referring to FIGS. 4A to 4E. FIGS. 4A to 4E schematically illustrate the hair styling manner by using a hair styling device (hair iron) equipped with the arm body 2 composed of the arms 2A and 2B. FIGS. 4A and 4B illustrate how the oscillator 9 placed in the arm 2B transfers to a direction of an arrow 33Y (tip direction of the arm 2B) drawn on the oscillator 9. When the oscillator 9 transfers to the direction of the arrow 33Y (tip direction of the arm 2B), hair 26 illustrated as a circle transfers (rotates) to the direction of the arm 2A (direction of an arrow 35Y) from a grounding point (black dot 37 in this drawing) to the oscillator 9. After the step of FIG. 4B, as illustrated in FIGS. 4C and 4D, the oscillator 9 placed in the arm 2B transfers to a direction of an arrow 34Y (a direction contrary to the tip of the arm 2B) and with this transfer, the hair transfers (rotates) to the direction of the arm 2B. After the steps of FIGS. 4C and 4D, as illustrated in FIG. 4E, the oscillator transfers to the point direction of the arm 2B and a series of steps from FIG. 4A are performed again. Thus, the oscillator 9 transfers (slides) in repetition to the right and left directions (longitudinal direction) of the arm on and along the arm 2B so that the hair retained by the arms 2A and 2B repeat right rotation and left rotation alternately, responding to the transfer of the oscillator. This means that a reciprocal rotating motion is repeated. Accordingly, the hair retained by the arms 2A and 2B repeatedly receives oscillation generated along the longitudinal direction of the arm by the oscillator 9 placed in the arm 2B and it undergoes a reciprocal rotation as if a "pastry pin" is rolled. The hair styling device of the present embodiment can therefore carry out soft hair treatment while maintaining the circular cross-sectional shape of the hair.

Figure 5A:
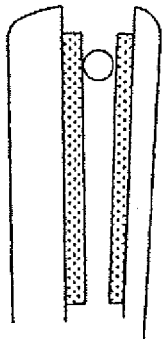
FIG. 5A is a partially enlarged view of an embodiment of the hair styling device according to the present invention and is also a schematic view illustrating the configuration of the hair when it is supported by the device.
Figure 5B:
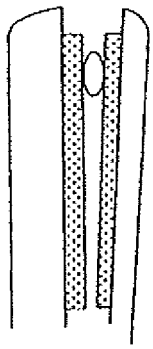
FIG. 5B is a partially enlarged view of an embodiment of the conventional hair styling device and is also a schematic view illustrating the configuration of the hair when it is supported by the device.

Thus, since the hair styling treatment by using the oscillator according to the present embodiment does not give an excessive contact pressure, the circular cross-sectional shape of the hair as illustrated in the schematic view of FIG. 5A can be maintained. The conventional oscillator, on the other hand, gives an excessive contact pressure to the hair because the hair is not rotated so that it is impossible to maintain the circular cross-sectional shape of the hair as illustrated in the schematic view of FIG. 5B and keep the elasticity and texture of the hair.

In FIG. 4, the oscillator 9 is placed only in the other arm 2B in which an arrow has been drawn and it is oscillated (slid), but the oscillator may be placed in the arm 2A. Alternately, it may be placed in both of the one arm and the other arm. When it is placed in both of these arms, the hair styling treatment may be performed while constituting the oscillators such that oscillation in a direction contrary to that given to one of the oscillators is given to the other oscillator. When the oscillator is placed in both arms, it seems as if two "pastry pins" as described above are attached to the upper arm (one of the arm) and the lower arm (the other arm) so that stable reciprocal rotation of the hair retained between these two arms can be performed. Such a constitution is therefore more preferred embodiment. The hair rotates according to the amplitude of the oscillator, but an increase in the number of rotations leads to hair breakage or damage so that it is preferred to give oscillation while controlling the amplitude of the oscillator to permit rotation of the hair within a predetermined range.

[1-5] Relationship Between Oscillator and Peripheral Members Thereof

The constitution of the oscillator, constitution of the peripheral members thereof, and their relationship will next be described referring to FIG. 3. FIG. 3 are partially enlarged cross-sectional views of the hair styling device 1, from which one of the arms is omitted for the convenience of description. The hair styling device 1 having a device main body 4A as a first gripper as illustrated in FIG. 3 is one of preferred embodiments. It is also preferred that although not illustrated in FIG. 3, the one arm 2A and the other arm 2B are constituted pivotably via the connection mechanism 5 (with the rivet portion 8 as an axis) by providing a second gripper, which is graspable with hands, integral with or in connection with the arm 2A and further by moving the first gripper, that is, the device main body and the second gripper to be closer to or away from each other by hands. According to such a constitution, the arm body can carry out retention or release work of the hair smoothly.

In the hair styling device 1 illustrated in FIG. 3, the motor 22, which is an oscillation generation means 3 serving as a power source, is placed in the device main body 4A, while the oscillator 9 is placed in the other arm 2B. A connection portion 11*a* for connecting the oscillator 9 with the oscillation transmitter 25 is placed on the surface side of the oscillator 9 contrary to the hair retention surface. In addition, an L-shaped portion 11*b*, which constitutes a part of the oscillation transmitter 25, is provided as a joint for transmitting the oscillation of the oscillation transmitter 25 to the oscillator via the connection portion 11*a*. This connection portion 11*a* and the L-shaped portion 11*b* constitute a connection structure 11.

By this connection structure 11, the oscillation generated by the oscillation means 3 is transmitted to the oscillator 9 via the oscillation transmitter 25 and a cam mechanism 10 composed of an eccentric cam 23 and a cam 24 and further, the oscillation is transmitted from the oscillator 9 to the hair. In other words, when the oscillation transmitter 25 receives the oscillation from the motor 22 through the cam mechanism 10, the oscillation transmitter 25 repeats sliding (oscillation) along the longitudinal direction of the device body 4A and the other arm 2B as an extension of the device body 4A. The oscillation is then transmitted to the oscillator 9 via the connection mechanism 11. Receiving the oscillation, the oscillator 9 then transmits the oscillation to the hair.

As illustrated in FIG. 3, an opening portion 12 is formed in the arm 2B. In the opening portion 12, an opening end portion 12*a* is formed at one end thereof, in the longitudinal direction of the arm 2B, and on the tip side of the arm 2B. An opening end portion 12*b* is, on the other hand, formed at the other end of the opening portion 12, in the longitudinal direction of the arm 2B, and on the side of the device main body 4*a*.

The opening portion 12 is formed because the oscillation transmitter 25 slides along the longitudinal direction of the arm 2B and the device main body 4*a* and with this sliding, the L-shaped portion 11*b* constituting the connection structure 11 slides between the opening end portions 12*a* and 12*b* along the longitudinal direction of the arm 2B. The L-shaped portion 11*b* is preferably formed so that it does not come into contact with each of the opening end portions 12*a* and 12*b*. Even if the L-shaped portion comes into contact, the contact is preferably of a subtle level, because direct hit of the L-shaped portion 11*b* to the opening end portions 12*a* and 12*b* makes it difficult to transmit the oscillation of the oscillation means 3 to the oscillator 9 accurately and repeat the reciprocal rotating motion of the hair stably.

When the L-shaped portion 11*b* comes into contact with the opening end portions 12*a* and 12*b* in a subtle level, it is preferred to constitute the oscillation transmitter 25 such that it can slide a distance corresponding to the length of the opening portion 12, that is, the lengths of the opening end portions 12*a* and 12*b*. Since the oscillation transmitter 25 can slide only a distance corresponding to the size of the opening end portions 12*a* and 12*b*, the oscillator 9 linked via the connection portion 11*a* of the connection structure 11 is preferably slidable only a distance corresponding to the size (length) of the opening end portions 12*a* and 12*b*.

The maximum transfer to the side of the arm 2B when the oscillator 9 transfers to the tip of the arm 2B occurs at the contact time of the L-shaped portion 11*b* of the connection structure 11 with the opening end portion 12*a*, while the maximum transfer to the side of the device main body 4A when the oscillator 9 transfers to the device main body 4A occurs at the contact time of the L-shaped portion 11*b* of the connection structure 11 with the opening end portion 12*b*. This means that the oscillator 9 is constituted such that it can be slid between the maximum transfer to the side of the arm 2B and the maximum transfer to the side of the device main body 4A.

When the L-shaped portion 11*b* of the connection structure 11 is brought into contact with the opening end portions 12*a* and 12*b*, the L-shaped portion 11*b* (or the opening end portions 12*a* and 12*b*) plays a role as a so-called stopper so that it is preferred to make the opening end portions 12*a* and 12*b* and the connection structure 11 from a material having strength such as pressure resistance, friction resistance, and heat resistance in order to avoid an excessive burden (impact) on each of the end portions.

It is also preferred to constitute the oscillator 9 such that it can slide in a recess 13 formed in the length direction of the arm 2B as illustrated in FIGS. 3A and 3B along the length direction of the arm 2B. The constitution of the oscillator is not limited thereto and it may be constituted such that it can slide on the arm 2B without forming the recess. When the recess is formed as illustrated in the drawing, it is preferred to form a contact end 14*a* at one end portion of the recess, which is in a tip direction of the arm 2B, and it is more preferred to form a contact end 14*b* at the end portion of the recess which is on the side of the first gripper 4A, that is, device main body. This keeps the sliding motion of the oscillator 9 within the recess and facilitates control of the oscillation given to the hair. There is a possibility that sliding of the oscillator greater than that desired may give excessive oscillation to the hair so that the sliding is preferably controlled to be within a desired range. Further, it is preferred to form the oscillator while controlling the size of it in a longitudinal direction. When the recess is equipped with such contact end 14*a* and contact end 14*b*, it is preferred to form the oscillation transmitter 25 while controlling the length of it so as not to give an excessive burden to the contact end 14*a* and the contact end 14*b*. An oscillator supporting portion 16 is preferably disposed because attachment of a member having a contact end to the arm 2B enables to form a recess in the arm 2B easily.

In FIGS. 3A and 3B, the oscillator is supported, at the bottom thereof, by the connection structure 11 and does not come into contact with the recess 13. The constitution is not limited thereto and the oscillator may be constituted such that it can slide while abutting on (coming into contact with) the recess 13. When the oscillator slides while abutting on (coming into contact with) the recess 13, the oscillator and a portion of the recess that the oscillator abuts on (comes into contact with) is preferably made of a member excellent in friction resistance.

Formation so as to avoid insertion of the hair between the oscillator and the contact end 14*a* and the contact end 14*b* of the recess by covering the recess in which the oscillator is placed is also a preferred embodiment. Rubber and the like can be used as a covering member. The recess may also be covered with a material having elasticity and oscillation transmitting property.

[1-6] Constitution of Hair Iron

The hair styling device constituted as a hair iron is also one of preferred embodiments. The hair iron is preferably constituted, for example, such that the oscillators 9 are placed in the arms 2A and 2B, respectively and oscillation generated by the oscillation means 3 is imparted to one or both of the oscillators or to these two oscillators alternately, because such a constitution enables to rotate the hair stably and achieve the advantage of the present application.

Figure 6:
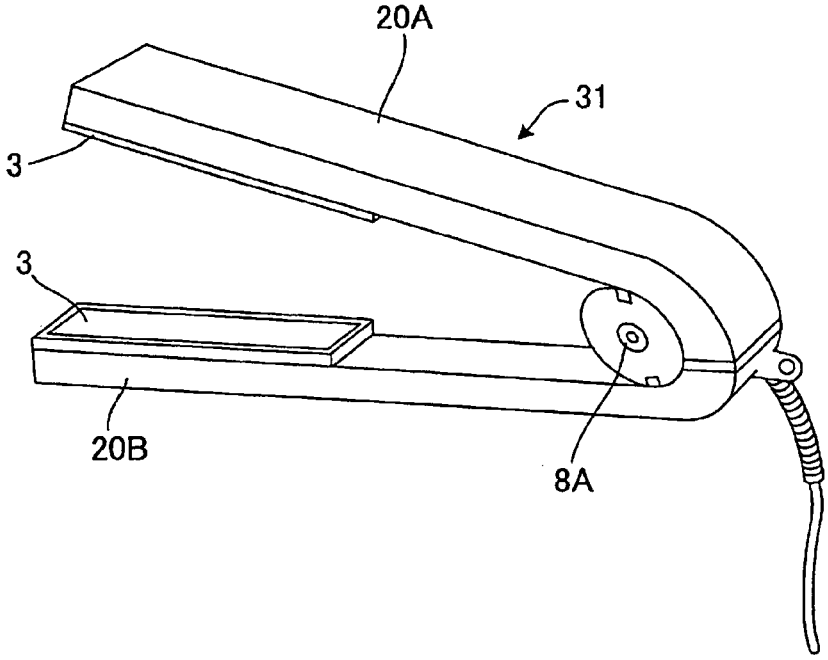
FIG. 6 is a schematic view illustrating Embodiment 3 of the hair styling device according to the present invention and is also a perspective view of the hair styling device whose arm body serves as a gripper.
Figure 7:
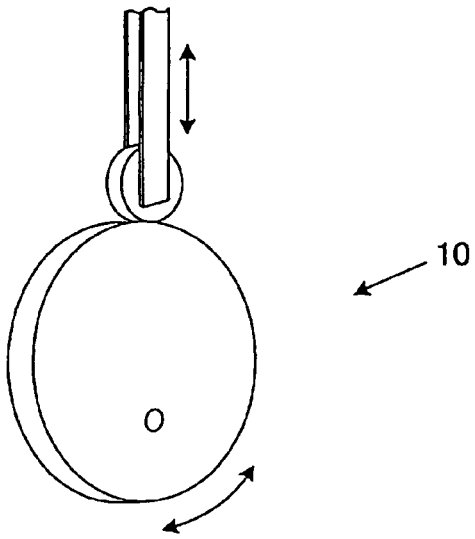
FIG. 7 is a schematic view of a cam mechanism for converting a rotating motion to a reciprocal motion.

The configuration of the iron is not limited to that illustrated in FIG. 1 and it is needless to say that the hair iron having a so-called bifurcated arm, for example, as illustrated in FIG. 6 may be embraced in the hair styling device of the present embodiment. In a hair iron 31 illustrated in FIG. 6, one arm 20A and the other arm 20B are connected pivotably via a rivet 8A. Accordingly, the hair iron 31 can retain the hair by rotating these upper and lower arms (arm 20B and arm 20B) via this rivet 8A to bring the arm 20A close to the arm 20B (or to bring the arm 20B close to the arm 20A). The hair thus retained can be separated from the arm by bringing the arm 20A away from the arm 20B (or bringing the arm 20B away from the arm 20A).

It is also preferred to equip the device with a control switch in order to control the oscillation and the magnitude of the amplitude or equip the device with a frequency selection switch in order to resonate the hair iron itself, resonate the arms 2A and 2B directly contiguous to the hair, and at the same time use it with an enhanced amplitude or change its resonance frequency. The resonance frequency of the arms 2A and 2B can also be changed by changing the thickness, width, or configuration of the arms 2A and 2B.

It is also preferred to form a portion of the hair iron to be brought into contact with the hair from an elastic material such as rubber. Such a hair iron is desired because it can reduce the contact pressure with the hair and therefore the hair can keep its soft circular cross-sectional shape without being damaged.

Repeated formation of mild wave patterns on the contact surface of one or both of the oscillators which are brought into contact with the hair is also one of the preferred embodiments. It not only reduces the contact pressure with the hair but also facilitates curling of the hair. In addition, due to the formation of mild wave patterns, the hair is not damaged and can keep its soft circular cross-section.

[1-6-1] Gripper of Hair Iron

Figure 8:
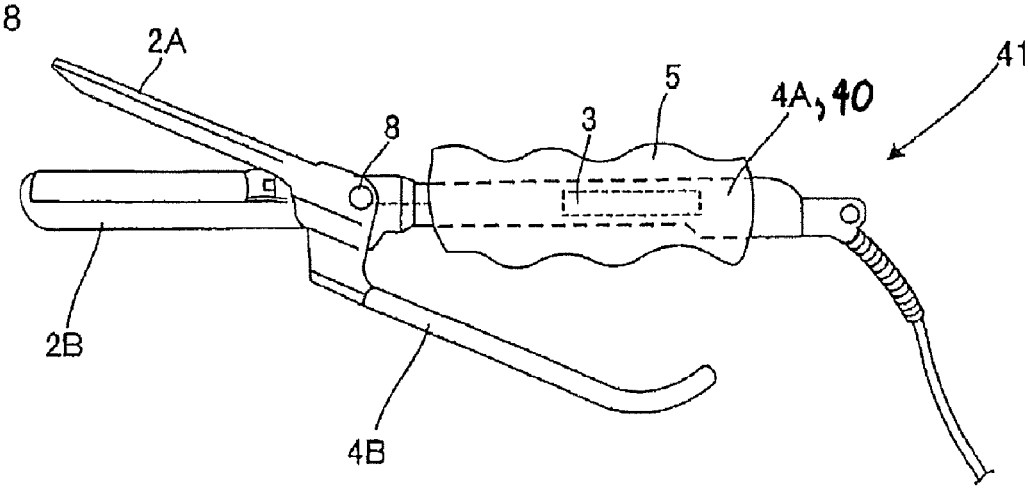
FIG. 8 is a schematic view illustrating Embodiment 2 of the hair styling device according to the present invention and is also a perspective view.

As illustrated in FIG. 1, when the oscillation means 3 is placed in the gripper 4A, it is preferred to place a vibration proof device. When the hair iron 1A itself oscillates, the oscillation transmits even to the hands of a person who grips the grippers 4A and 4B. The vibration proof device is placed in order to prevent transmission of the oscillation to hands. For example, as illustrated in FIG. 8, the hair iron is preferably constituted as a hair iron 41 having, as the vibration proof device, an oscillation absorber 40 such as a dynamic oscillation absorber placed in the gripper 4A.

The gripper is preferably made of a metal material such as titanium alloy, duralumin, aluminum alloy, or steel. It is preferably formed by cutting a columnar metal material. When the gripper is the device main body, the oscillation means 3 is often incorporated (placed) therein so that in this case, it has preferably a hollow shape. The material is not limited to the above metal material and it is not limited to the column shape. The gripper may be made of any material insofar as it is excellent in oscillation resistance and lightweight properties and at the same time has heat resistance. A material easy to hold with hands, excellent in operability, and having a shape facilitating placement of the above constituting member such as oscillation means therein is a preferred embodiment for forming the gripper of the hair iron. As described above, a light weight gripper is preferred because an excessively heavy gripper may interrupt the hair styling work.

[1-6-2] Another Constitution of Hair Iron

Figure 9:
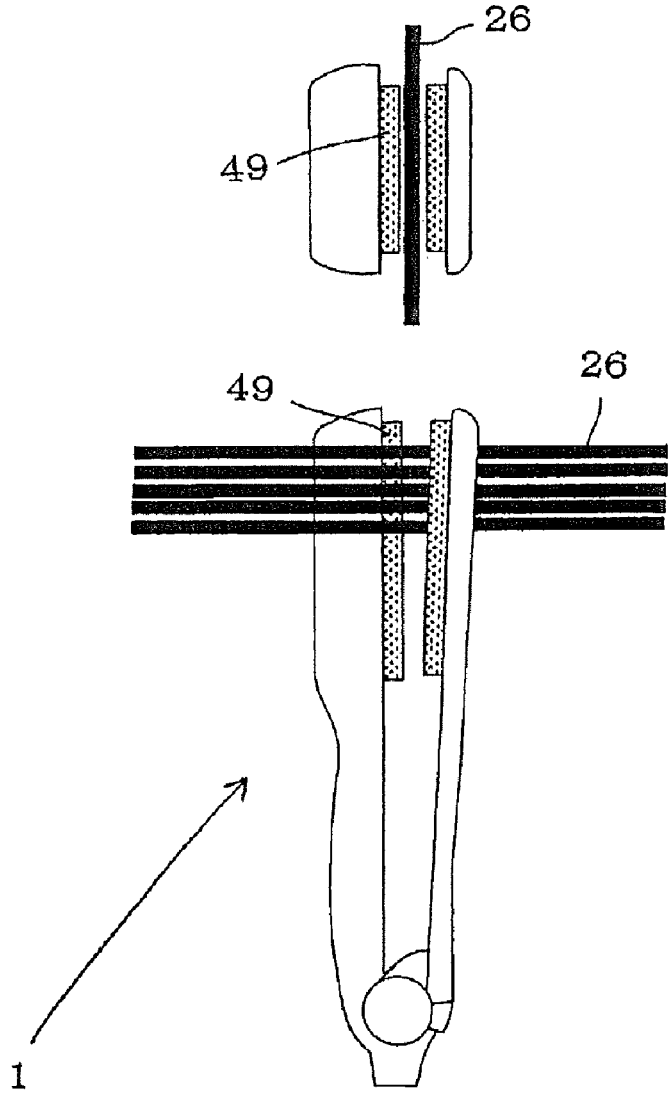
FIG. 9 is a schematic view illustrating Embodiment 4 of the hair styling device according to the present invention and is also a schematic view illustrating the hair supported by the hair styling device having, in an oscillator thereof, a heater.

It is also preferred that as illustrated in FIG. 9, the hair iron 1 is equipped with a unit for applying heat to the hair 26, for example, by incorporating a heater 49 having an oscillator therein in the upper and lower arms (the one arm and other arm). When the arms 2A and 2B are heated directly, it is preferred to control the temperature at from 60 to 200° C.

[1-7] Using Method of Hair Styling Device

Figure 10:
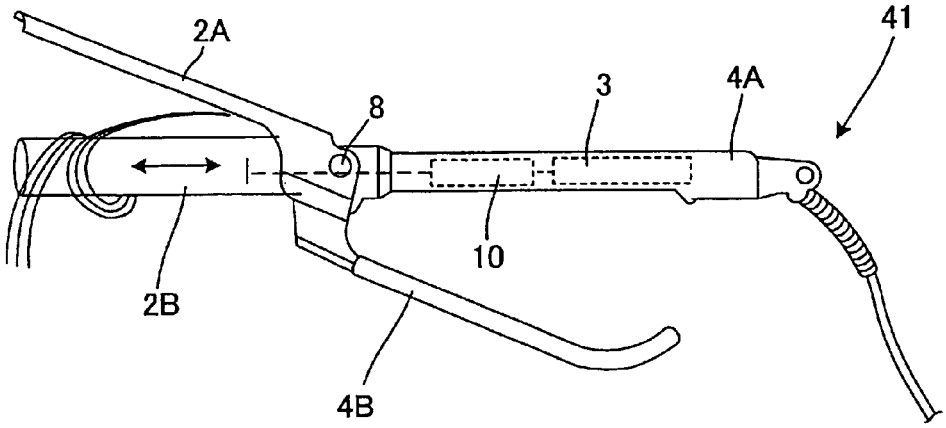
FIG. 10 is a perspective view of an embodiment of a hair styling device to be used for the hair styling method according to the present invention.

As illustrated in FIG. 10, the one arm 2A and the other arm 2B are opened by separating the second gripper 4B from the first gripper 4A by using hands. The hair subjected to softening treatment is wrapped around the arm 2B and is abutted on a portion of the arm 2B in which the oscillator is placed. The gripper 4B and the gripper, that is, the device main body 4A are brought into contact with each other by hands to rotate (open and close) the arms 2A and 2B and caused to hold the hair in the arm body. The hair styling device 1 is turned ON to give oscillation to the hair. When another hair is brought into contact with the oscillator 9 of the arm 2B, the gripper 4B and the gripper, that is, device main body 4A are kept away (separated) from each other by hands again, the arm 2A and the arm 2B are rotated (opened) for separation, and the position of the hair to be brought into contact with the one arm or the other arm is adjusted. The above step is repeated. When the hair is wrapped around the arm 2B, uneven wrapping thickness may lead to failure in obtaining a sufficient advantage so that it is desired to wrap the hair so as to abut on the oscillator without unevenness.

[2] Hair Styling Method

The best mode for carrying out the hair styling method of the present invention will hereinafter be described specifically referring to some drawings. It should however be borne in mind that the invention widely embraces a hair styling method equipped with the defining matters of the present invention and is not limited to the following embodiments.

[2-1] Constitution of the Hair Styling Method of the Present Invention

The hair styling method of the present invention can preferably use the above-described hair styling device. The hair styling method of the present invention is constituted such that it can impart a desired hair style to the hair softened by softening agent application or spraying or the hair applied with a hair conditioner. The method is characterized in that a reciprocal rotating motion of the hair is repeated by giving to the hair oscillation having a predetermined frequency from 1 to 20000 Hz, while retaining the hair softly enough to prevent crashing of the hair subjected to softening treatment.

[2-2] Hair to be Styled in the Present Invention

The hair to which a desired hair style is given by using the hair styling method of the present invention is that softened by softening agent application or spraying or that applied with a hair conditioner (which may hereinafter be called "hair subjected to softening treatment" as needed). This means that the hair styling method of the present invention is used for hair styling and it is used for the hair softened by applying or spraying a softening agent to the hair. This softening method is performed by carefully applying or spraying a first lotion (softening agent) to the shampooed hair.

[2-2-1] Hair Softening Agent (Hair Conditioner)

Examples of the hair softening agent (hair conditioner) include hair dyes, conditioners, and set lotions, more specifically, hair manicures, hair conditioners, hair styling agents, hair rinses, hair creams, hair mousses, hair gels, and hair packs.

[2-3] Desired Hair Style

Although no particular limitation is imposed on the desired style which can be imparted to the hair by using the hair styling method of the present invention, the method is suited for use in hair styling such as permanent waving or permanent hair straightening given to the hair which has been softened by applying or spraying a softening agent or has been applied with a hair conditioner.

[2-3-1] Permanent Waving

One of permanent waving methods comprises shampooing hair, softening the hair with a first lotion, grasping a predetermined amount of the resulting hair while combing, aligning the resulting hair bundle from the hairline to the tip of the hair, and changing the hair into a desired style by waving (curling) the hair in a certain direction with a hair iron or wrapping the hair on a hair rod so that a substantially uniform tension is applied from the hairline to the tip of the hair.

[2-3-2] Permanent Hair Straightening

One of the permanent hair straightening method comprises shampooing hair, grasping a predetermined amount of the resulting hair while combing, aligning the resulting hair bundle from the hairline to the tip of the hair, applying or spraying a first lotion to the hair to soften it, aligning the bundle of hair, which has been grasped in a predetermined amount while combing, from the hairline to the tip of the hair, and straightening the hair bundle with, for example, a hair iron.

[2-4] Oscillation Imparting Method

In the hair styling method of the present embodiment, it is preferred to give, to the hair, oscillation having a predetermined frequency ranging from 1 to 20000 Hz while retaining the hair carefully so as not to collapse it and thereby repeat reciprocal rotating motion of the hair. The hair is retained carefully enough to prevent collapse of it is because pushing the hair strongly to cause collapse of it is not desired because it damages the hair. It is possible to repeat a reciprocal rotating motion of the hair by giving (imparting), to the hair subjected to softening treatment, oscillation having a predetermined frequency from 1 to 20000 Hz. In other words, the reciprocal rotation motion of the hair can be repeated out only when the hair is oscillated in an almost parallel and cross direction against the longitudinal direction of the hair. Described more specifically, when the hair styling device described above is used, adding (imparting) oscillation to the side surface of the hair along the longitudinal direction of the arm enables to repeat a reciprocal rotating motion. The term "reciprocal rotating motion" as used herein embraces rotation less than 360°. When the predetermined frequency of the oscillation is the minimum value, the hair makes at least a reciprocal motion while rotating along the outer circumference of the hair, though it does not make a rotating motion, whereby the hair can retain its soft circular cross-section without being damaged. It is however more preferred that at least one reciprocal rotating motion is performed, because such a reciprocal rotating motion facilitates treatment into a desired hair style and contributes to the attainment of the advantage of the present application. Accordingly, it is desired to increase the frequency to be imparted to the hair within the predetermined frequency, because a reciprocal rotating motion is repeated along the outer circumference of the hair, depending on the oscillation having the above-mentioned frequency so that the hair is not damaged and can keep its soft circular cross-section while enabling a desired hair styling.

The hair styling method of the present embodiment is preferably performed with oscillation having a frequency within a range of from 10 to 100 Hz. The amplitude can be made greater at oscillation having a frequency within a range of from 10 to 100 Hz, that is, low-frequency oscillation. In other words, when such low-frequency oscillation is given (imparted) to the hair by using, for example, the above-described hair styling device, it can be given (imparted) to the hair from the side surface of the hair along the longitudinal direction of the arm. The hair subjected to a great amplitude rolls along the outer circumferential direction of the hair stably and moreover, repeats a reciprocal rotating motion. As a result, the hair can keep its soft circular cross-section without being damaged so that the low-frequency oscillation is preferred. According to the hair styling method having such a constitution, it is possible to cause penetration and action of the first lotion into the further detail of the hair even if the hair styling is performed for a period of time equal to or less than that necessary for the conventional hair styling. As a result, delicate hair style can be given to the hair and at the same time, the hair style thus imparted to the hair can be retained for a long period of time. The reason is not clear but such an advantage is presumed to exist because hair styling while applying oscillation from a predetermined direction promotes penetration of the first lotion to the hair to soften it and thereby enhances the effect of the first lotion. It becomes possible to keep the elasticity and texture of the hair by controlling the frequency of the oscillation means to fall within a desired range.

In the hair styling method according to the present embodiment, the amplitude of the oscillation to be imparted to the hair falls preferably within a range of from 0.001 to 10 mm, more preferably from 0.2 to 1 mm. In general, the human hair has a width of from 0.06 to 0.1 mm and a perimeter of from 0.19 to 0.31 mm. When a reciprocal rotation motion of hair is repeated, it is performed at an amplitude falling within a predetermined range so that the hair can keep its soft circular cross-section without being damaged due to excessive limitation to only right rotation or left rotation or excessive rotation. The hair can therefore keep its elasticity and texture.

The perimeter of the hair corresponding to one rotation is from 0.19 to 0.31 mm and the perimeter of the hair corresponding to two rotations is from 0.38 to 0.63 mm, and the perimeter of the hair corresponding to three rotations is from 0.57 to 0.94 mm. The amplitudes not greater than 0.001 mm are not preferred because the hair does not rotate or does not rotate smoothly. The amplitudes exceeding 10 mm are also not preferred because they correspond to from 30 to 50 rotations and there is a possibility of them causing hair breakage.

When the hair styling is performed using the above-described hair styling device preferred in the present embodiment, the oscillation is given to the hair along the length direction of the arm via the oscillator so that after repetition of the reciprocal rotating motion and completion of the operation of the oscillation means, there does not occur much twisting of the hair attributable to the rotating motion. Described specifically, when the cross-section of the hair is viewed from the front as illustrated in FIG. 6, right rotation and left rotation of the hair to which the oscillation is given (imparted) are repeated alternately so that there is no possibility of excessive twisting due to the rotation occurring only in a right rotation direction or left rotating direction. It is therefore possible to decrease the hair twisted in a right or left direction after completion of the use of the hair styling device. Although the reason is not clear, hair styling while giving (imparting) oscillation in a predetermined direction is presumed to enhance the hair softening effect of the first lotion by promoting the penetration of the first lotion into the hair.

When the hair styling method of the present invention is performed in such a manner, the hair style is kept in an ordinary life, for about 3 months by one hair styling treatment. During this period, the hair style thus obtained can be kept almost as is. If somewhat style loss is included, the effect of the method lasts for about 5 months. When a similar hair styling treatment is performed without giving oscillation, the resulting hair style can be kept for only about 2 months. Even if somewhat style loss is included, the hair style retention effect lasts for only about 3 months.

As described above, the reason why the hair style thus obtained can be kept for a prolonged period of time after hair setting is not clear. It is however presumably because the hair styling treatment extends even to the detail of the hair and cystine bond and the like of the keratin is restored even in the detail of the hair. More specifically, it is presumably because the hair styling treatment while giving oscillation to the hair from a desired direction promotes penetration of the first lotion to the hair and enhance the effect of the first lotion; and the amplitude of the oscillation can be made greater than that of ultrasonic oscillation by reducing the frequency of the oscillation and in addition, the oscillation is given from the side surface of the hair so that a circular cross-section thereof can be maintained without being damaged and the elasticity and texture of the hair can be maintained.

It is difficult to think that during permanent waving, the frequency of the oscillation given unintentionally to a hair iron or the like in the behavior of hairdressers or beauticians such as stroking, pulling or patting of the hair with an arm portion of the hair iron reaches a high frequency zone such as ultrasonic region. Accordingly, the hair styling treatment in the frequency zone defined in the present invention acts like the behavior of hairdressers, resulting in the above-described advantage of the invention, which is however, a matter for speculation.

As described above, considering that physical treatment to impart predetermined oscillation to the hair promotes penetration of the first lotion thereto and enhances the effect of the first lotion, the present invention is expected to produce an excellent effect in the hair treatment such as hair manicure or application of a hair conditioner.

Based on this consideration, the hair (head hair) of a person was observed after applying a hair manicure thereto and treating two bundles of the hair picked up from the resulting hair with hair irons having almost the same shape for same hours, respectively while giving oscillation to one of the hair bundles and not giving oscillation to the other one. As a result, it was confirmed that oscillation in a certain direction improved the hair luster.

This means that styling the hair applied with a conditioner or the like while giving oscillation having a predetermined frequency or styling the hair by adding oscillation having a predetermined frequency while applying a conditioner or the like to the hair enables the conditioner to penetrate even to the detail of the hair and produce its effect fully and at the same time, it enables to shorten the hair styling time. In addition, it is expected to produce an effect of keeping the resulting hair style for a prolonged period of time.

[2-4] Hair Styling Method with a Hair Iron Suited for Use in the Present Embodiment It is desired to carry out hair styling with a hair iron suited for use in the above-described hair styling method. Using the hair iron [1-5] described above is preferred as the iron suited for use in the present embodiment.

In hair styling with a hair iron, it is preferred to employ a method of applying a heat of a predetermined temperature to the hair at any point of time before, during, or after oscillation is given to the hair. Addition of heat enables to enhance the plasticity of the hair and compared with the case where only oscillation is given, time necessary for imparting a desired hair style to hair can be decreased.

There are roughly three methods to give (impart) oscillation to hair by sliding an oscillation plate placed in one arm and the other arm of a hair iron, that is, a method of oscillating only one arm, a method of oscillating two arms, and a method of oscillating these two arms alternately. In the present invention, any one of these methods may be employed, depending on the intended hair style.

As the hair iron to be used in the present embodiment, there are various types such as flat iron and round iron, depending on the shapes of one arm and the other arm (upper and lower arms). The present invention is however not limited by the type of it. The hair iron having a type (width, diameter, shape) suited for the hair and intended use is preferred.

As described above, the hair styling method of the present invention enables to restore the cystine bond and the like, which have been broken minutely even in the detail of the hair, due to the action of the second lotion compared with the conventional perming. Thus, the hair style imparted even to the detail of the hair can be maintained so that the hair style does not collapse and lasts long even shampooing or the like is repeated after the hair styling.

INDUSTRIAL APPLICABILITY

As described above, the present invention enables to produce the effect of the first lotion (softening agent) fully and provide it even to the detail of the hair in perming such as permanent hair straightening or permanent waving. It enables to smoothen hair styling and shorten the hair styling time. After hair setting treatment, the hair style is imparted even to the detail of the hair and the cystine bond and the like of keratin is restored even in the detail of the hair so that the hair style thus obtained can be kept for a long period of time. Further, the present invention enables to carry out delicate hair styling which the conventional permanent waving cannot actualize and impart elegant or unique hair style to the hair.

The invention claimed is:

1. A hair styling device for giving a desired hair style to hair softened by softening agent application or spraying or hair applied with a hair conditioner, which comprises:

a device main body;

an arm body extending from the device main body, the arm body having one arm having a longitudinal axis and an other arm opposing the one arm and connected pivotably to the device main body via a connection mechanism;

an oscillation means placed in the one arm or the other arm or the device main body and generating oscillation having a predetermined frequency, and an oscillator placed in the one arm or the other arm and constituted such that the oscillator can transmit the oscillation generated by the oscillation means to the hair, wherein:

the arm body is constituted such that the arm body can retain or release the hair by rotating the connection mechanism, the oscillation generated by the oscillation means has a predetermined frequency ranging from 1 to 20000 Hz, and the oscillator is constituted such that the oscillator slides in a reciprocating manner relative to the other arm along the longitudinal axis to transmit the oscillation from the oscillation means to the hair such that when the arms are brought together to retain the hair, the arms are substantially parallel the longitudinal axis and the hair retained between the one arm and the other arm is reciprocally rotated.

2. The hair styling device according to claim 1, wherein:

the device main body is constituted as a first gripper graspable with a hand, a second gripper graspable with a hand is placed integral or in connection with the one arm of the arm body, and the one arm and the other arm are constituted as the arm body rotating via the connection mechanism by opening or closing the first gripper and the second gripper.

3. The hair styling device according to claim 1, wherein the oscillation of the oscillation means has a variable amplitude ranging from 0.001 to 10 mm.

4. The hair styling device according to claim 1, wherein the frequency of the oscillation means is constituted variable.

5. The hair styling device according to claim 1, wherein the hair styling device is a hair iron.

6. The hair styling device according to claim 5, wherein the device is the hair iron as claimed in claim 5, the oscillators are placed in the one and the other arms, respectively, and the oscillation generated by the oscillation means is given to either one or both of the oscillators, or given to the oscillators alternately.

7. The hair styling device according to claim 6, wherein:

a contact surface to be brought into contact with the hair is placed in either one or both of the oscillators, and the contact surface has been subjected to treatment for repeatedly forming slow wave patterns thereon.

8. The hair styling device according to claim 1, wherein a portion of the hair styling device to be brought into contact with the hair is made of an elastic material.

9. A hair styling method for imparting a desired hair style to hair softened by softening agent application or spraying or hair applied with a hair conditioner, which comprises:

giving, to the hair, oscillation from an oscillator having a predetermined frequency ranging from 1 to 20000 Hz while holding the hair carefully enough to avoid collapse thereof and thereby repeatedly reciprocally rotating the hair about a longitudinal axis thereof, wherein the oscillator moves perpendicular to the longitudinal axis of the hair and, thereby, imparts the repeated reciprocal rotation to the hair while maintaining a circular cross-sectional shape of the hair.

10. The hair styling method according to claim 9, wherein the oscillation to be imparted to the hair has an amplitude falling within a range of from 0.001 to 10 mm.

11. The hair styling method according to claim 9, wherein the hair styling is performed with a hair iron suited for use in the hair styling method.

12. The hair styling method according to claim 9, wherein a portion to be brought into contact with the hair is made of an elastic material.

13. The hair styling method according to claim 9, wherein the hair is oscillated in a direction that is almost perpendicular with the longitudinal axis of the hair.

14. The hair styling method according to claim 13, further comprising the step of carefully retaining the hair in between elongated arms, each arm having an arm axis, wherein each arm axis is parallel to the direction that the hair is oscillated.

15. A styling device for hair comprising:

a main body housing a motor and a cam mechanism coupled to the motor;

a first arm extending from the main body along an arm axis and having an oscillator portion coupled to the cam mechanism so that the motor causes the oscillator portion to oscillate along the arm axis; and a second arm opposing the first arm and pivotably connected to the main body for selectively retaining the hair in a direction substantially perpendicular to the arm axis without crushing the hair, wherein when the hair is retained within the arms, the oscillator portion moves perpendicular to a longitudinal axis of the hair and, thereby, imparts a reciprocal rotating movement to the hair while maintaining a circular cross-sectional shape of the hair.

16. A styling device as recited in claim 15, wherein:

the cam mechanism includes an eccentric cam coupled to the motor, a cam coupled to the eccentric cam and an oscillation transmitter coupled to the cam; and the oscillator portion includes a first side opposing the second arm and a second side opposing the first side, the oscillation transmitter being coupled to the second side.

* * * * *